US005194047A

United States Patent [19]

Cabell

[11] Patent Number: 5,194,047

[45] Date of Patent: Mar. 16, 1993

[54] PORTABLE SCENE STORING, SETTING, AND RAPID CHANGE ASSEMBLY

[76] Inventor: William D. Cabell, P.O. Box 43, South Tamworth, N.H. 03883

[21] Appl. No.: 704,801

[22] Filed: May 23, 1991

[51] Int. Cl.[5] ..... A63J 1/02

[52] U.S. Cl. ..... 472/75; 472/77

[58] Field of Search ..... 472/75–77; 135/901, 102

[56] References Cited

U.S. PATENT DOCUMENTS

| | | | |
|---|---|---|---|
| 653,997 | 7/1900 | Hagen . | |
| 656,969 | 8/1900 | Hagen . | |
| 895,359 | 8/1908 | Fortuny | 472/77 |
| 1,027,922 | 5/1912 | Spikes | 472/75 |
| 1,449,076 | 3/1923 | Wellman | 472/77 X |
| 1,583,775 | 5/1926 | Brandt | 472/75 X |
| 1,600,039 | 9/1926 | Cunningham . | |
| 2,670,956 | 3/1954 | Ganz . | |
| 3,899,168 | 8/1975 | Besherse | 472/75 |
| 4,926,893 | 5/1990 | Klopfenstein et al. | 135/901 |

*Primary Examiner*—Richard E. Chilcot, Jr.
*Attorney, Agent, or Firm*—John R. Flanagan

[57] ABSTRACT

A portable assembly for storing, setting up, and rapidly changing elements of different theatrical scenes includes a pair of anchoring members respectively locatable at opposite ends of a stage area, and an elongated stationary track mountable solely at its opposite ends by the anchoring members so as to extend in an arched configuration over the stage area. The portable assembly also includes members connectable to the elements of scenes and movably mountable to the arched track for interconnecting the elements of scenes successively in a row and supporting the scenes from the track for movement along the track to and from centerstage and offstage areas. Further, the portable assembly includes panels locatable adjacent to the anchoring members and the opposite ends of the arched track for hiding offstage the anchoring means and the ones of the elements of scenes supported by the arched track but not presently being displayed at the centerstage area.

20 Claims, 2 Drawing Sheets

PORTABLE SCENE STORING, SETTING, AND RAPID CHANGE ASSEMBLY

BACKGROUND OF THE INVENTION

1. Field of the Invention

The present invention generally relates to theatrical production equipment and, more particularly, is concerned with a portable assembly for storing, setting up, and rapidly changing elements of different scenes in a theatrical production.

2. Description of the Prior Art

Theatrical productions, both large and small, require some kind of equipment for setting up scenes as well as for changing from one scene to the next. The equipment used in putting on large theatrical productions typically is too elaborate and costly to be used in small ones, such as take place at schools and small theaters. It would be highly desirable to have available simple, inexpensive and appropriate equipment that can be employed by schools and small theaters.

A variety of equipment for setting up and changing theatrical scenes is found in the prior patent art. A representative sampling is the equipment disclosed in U.S. Patents to Hagen (U.S. Pat. Nos. 653,997 and 656,969), Cunningham (U.S. Pat. No. 1,600,039), and Ganz (U.S. Pat. No. 2,670,956). Of these, only the stage backdrop equipment of the Ganz patent would likely be applicable to small theatrical productions. However, even this equipment appears to be to cumbersome and costly to be useful.

Consequently, a need still remains for improvements in theatrical production equipment which will overcome the shortcomings found present in the prior art.

SUMMARY OF THE INVENTION

The present invention provides a portable scene storing, setting and rapid change assembly designed to satisfy the aforementioned needs. For the sake of brevity, hereinafter the portable scene storing, setting and rapid change assembly will be referred to simply as the "portable assembly".

The portable assembly of the present invention provides simple and inexpensive equipment for storing, setting up and easily changing elements of different scenes during the theatrical production. The portable assembly has application not only in the puppet theater field, but also in schools and other small theater areas. The portable assembly also is versatile in that the elements of a considerable number of scenes, for instance as many as four to five, can be prepared and stored on portions of the portable assembly which are hidden offstage. Then, when the moment arrives to set up the stored elements of the next scene, they can be quickly and easily pulled onto centerstage simultaneously as the elements of the last scene are pulled offstage.

Accordingly, the present invention is directed to a portable assembly for storing, setting up, and rapidly changing elements of different theatrical scenes. The portable assembly comprises: (a) a pair of anchoring means locatable at respective opposite ends of a stage area; and (b) an elongated stationary track mountable solely at its opposite ends by the anchoring means so as to extend in an arched configuration over the stage area.

More particularly, the anchoring means includes a pair of end platforms locatable at opposite ends of the stage area, and a pair of members attached respectively on the end platforms and capable of receiving the opposite end of the track so as to mount the track in a stationary upright position extending in the arched configuration over the stage area. Also, the track includes an elongated rod formed in the arched configuration and having attaching elements defined on its opposite ends for fitting with the anchoring means. The rod includes a plurality of rod sections coupled together in end-to-end relation.

Additionally, the portable assembly comprises means connectable to the elements of scenes and movably mountable to the arched track for interconnecting the elements of scenes successively in a row and supporting the scenes from the track for movement along the track to and from centerstage and offstage areas. The connectable means includes at least one elongated sleeve being insertable over and slidably movable along the track. The interconnecting means also includes means mounted on the sleeve for releasably fastening scene elements on the sleeve.

The portable assembly further comprises means locatable adjacent to the anchoring means and the opposite ends of the arched track for hiding from view the anchoring means and the ones of the elements of scenes supported by the arched track but not presently being displayed at the centerstage area. The hiding means includes panels supported upright adjacent to and forwardly of the opposite ends of the arched track.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
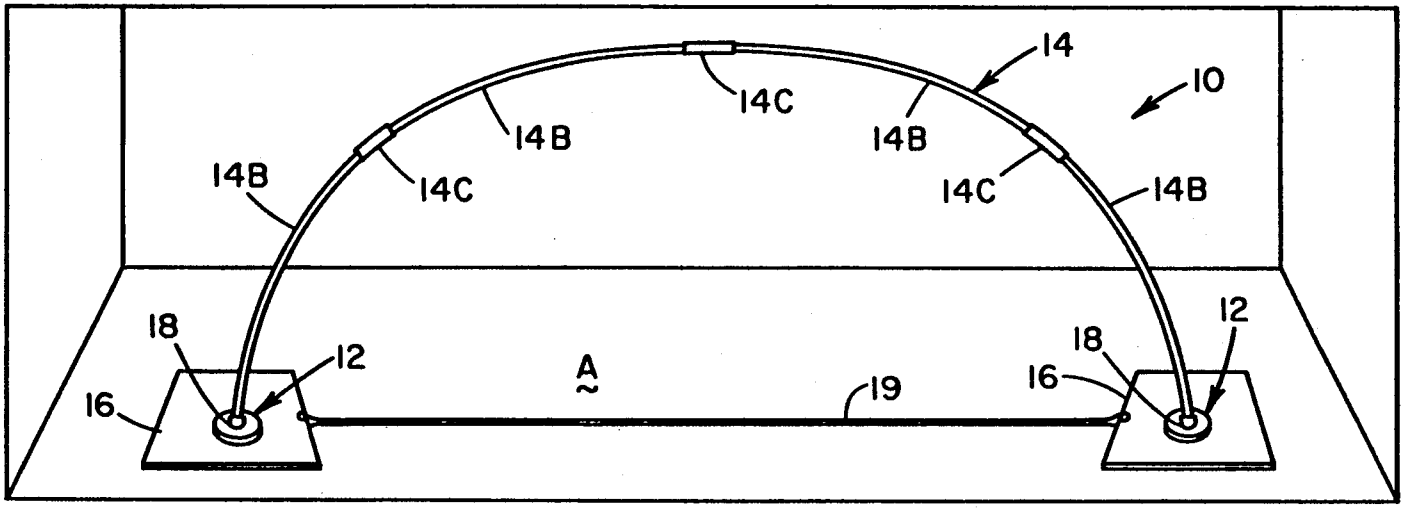
FIG. 1 is a front elevational view of a portable scene storing, setting and change assembly of the present invention, the scene storing, setting and change assembly being illustrated in a stripped condition.

In the following description, like reference characters designate like or corresponding parts throughout the several views of the drawings. Also in the following description, it is to be understood that such terms as "top", "bottom", "front", "rear" and the like, are words of convenience and are not to be construed as limiting terms.

Figure 2:
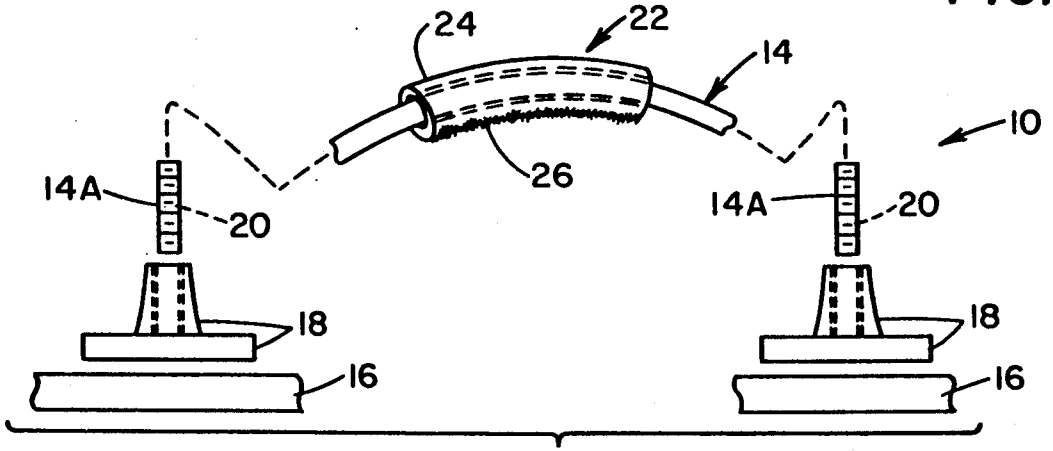
FIG. 2 is an enlarged fragmentary exploded view of the components of the scene storing, setting and change assembly of FIG.1.

Referring to the drawings, and particularly to FIGS. 1-2, there is illustrated a portable assembly, generally designated 10, for storing, setting up, and rapidly changing elements E of different theatrical scenes in accordance with the principles of the present invention. In its basic components, the portable assembly 10 includes a pair of anchoring means 12 locatable at respective opposite ends of a stage area A, and an elongated stationary track 14 mountable solely at its opposite ends 14A by the respective anchoring means 12 so as to extend in an arched configuration over the stage area A.

More particularly, each anchoring means 12 includes a movable end platform 16 locatable at one of the opposite ends of the stage area A, and a mounting member 18 attached on the end platform 16 and capable of receiving one of the opposite ends 14A of the track 14 so as to mount the track 14 in a stationary upright position extending in the arched configuration over the stage area A. Preferably, the mounting members 18 are threaded pipe flanges attached centrally on the end platforms 14. The end platforms 16 lie flat on the stage surface providing 360° lateral support for the respective opposite ends 14A of the track 14. A cord 19 may be extended between and interconnected with the end platforms 16 so as to resist the tendency of the track 14 to straighten out from moving the end platforms 16 further apart.

The track 14 is an elongated rod composed of a suitable material, such as fiberglass, aluminum, etc., and formed in the arched configuration. The rod 14 has attaching elements 20 in the form of threaded fittings on its opposite ends for threadable connection with the mounting flange members 18 of the anchoring means 12. The rod 14 is composed of a plurality of rod sections 14B connected together in end-to-end relation by tubular couplers 14C.

The portable assembly 10 also comprises means 22 connectable to the elements E of scenes and mountable to the arched track 14 for sliding movement along the track 14. The means 22 is preferably one or more elongated hollow sleeves 24 insertable over and slidably movable along the track 14 for interconnecting the elements E of scenes successively in a row and supporting the scenes from the track 14 for movement along the track 14 to and from centerstage and offstage areas. Also, such means 22 includes fastening means such as hook or pile patches 26 mounted on the exterior of the sleeves 24 for releasably fastening scene elements E on the sleeves 24.

The portable assembly 10 further comprises means locatable adjacent to the anchoring means 12 and the opposite ends 14A of the arched track 14 for hiding from view the anchoring means 12 and the ones of the elements E of scenes supported by the arched track 14 but not presently being displayed at the centerstage area. Such hiding means includes panels 28 freestanding upright or supported upright by the end platforms 16 adjacent to and forwardly of the opposite ends 14A of the arched track 14 and the anchoring means 14.

Figure 3:
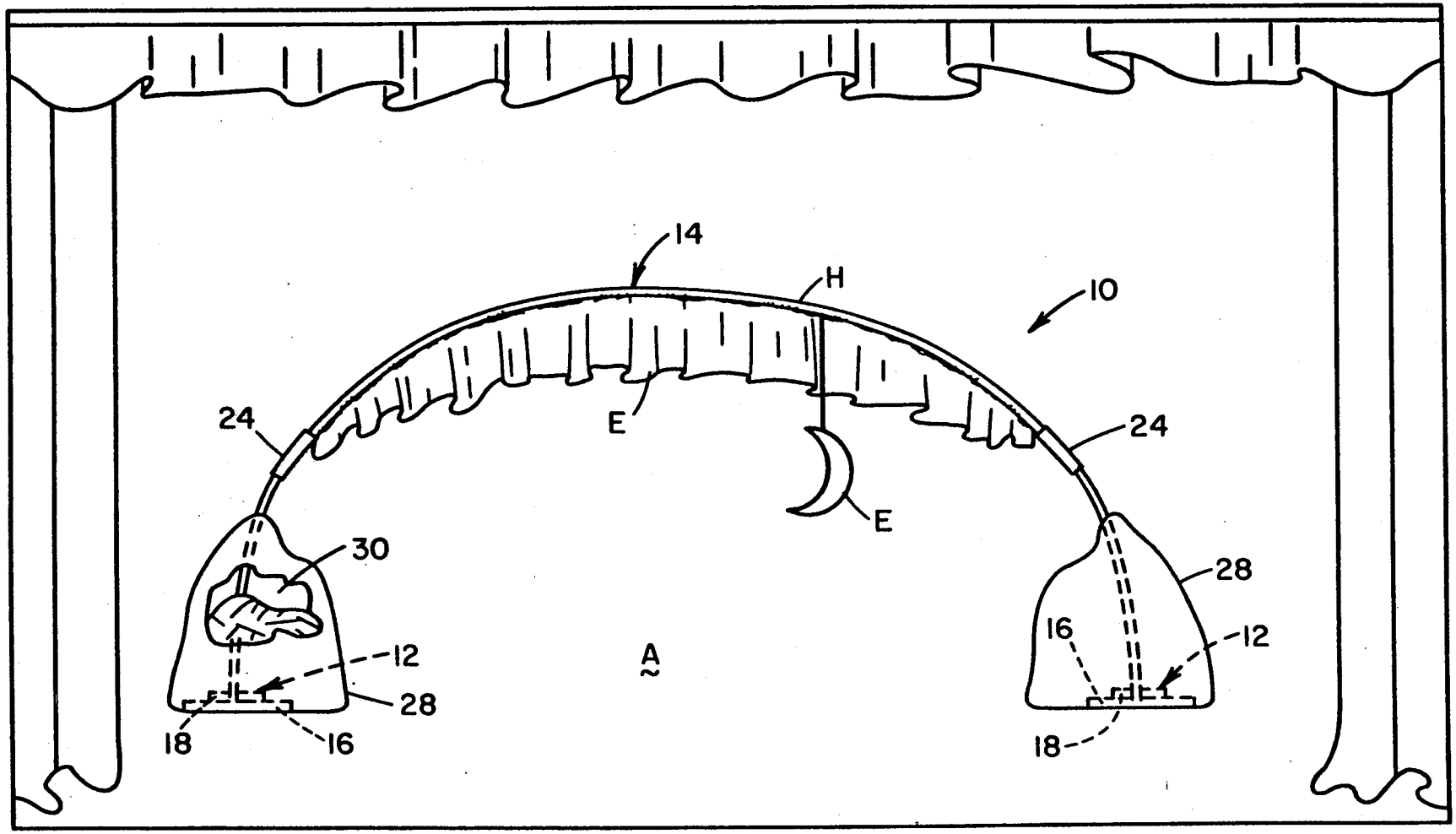
FIG. 3 is a front elevational view of the scene change assembly of FIG. 1, the scene storing, setting and change assembly being illustrated in a dressed condition.

Referring to FIG. 3, there is illustrated the portable assembly 10 in a condition dressed with elements E of a scene. The scene elements E are installed on the track 14 before it is fitted at its opposite ends 14A to the flange members 18 on the end platforms 16. Some of the scene elements E have hemmed edges H, forming the hollow sleeve 24, which can be slipped onto the rod or track 14. In some instances, the trailing end of a given scene element is attached to the leading end of the next scene element. In other cases where a gap is desired or no scenery is wanted, one of the sleeves 24 is inserted between successive scene elements E and provided the interconnection between them. Also, the hook or pile patches 26, being material commonly known by the trademark Velcro, permit the hanging of scene elements E from the sleeve 24 as desired.

To operate the assembly to change scenes, a person on either side pulls the sleeve 24 or scene element E from centerstage until a succeeding scene element E is moved from offstage to centerstage and revealed from behind the panels 28. The panels 28 can be cut to whatever shape is desired to serve as part of the stage scenery also. The number of scenes which can be hidden offstage is limited solely by how much fabric can be bunched up, such as seen at 30 in FIG. 3, behind the panels 28.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A portable assembly for storing, setting up, and rapidly changing elements of different theatrical scenes, said portable assembly comprising:
   (a) a pair of anchoring means locatable at respective opposite ends of a stage area; and
   (b) an elongated stationary track mountable solely at its opposite ends by said anchoring means so as to extend in an arched configuration over the stage area;
   (c) each of said anchoring means including an end platform being a generally planar structure adapted to lie flat on the stage area and support one of said opposite ends of said track by extending laterally from and 360° about said one end of said track.

2. The portable assembly of claim 1 wherein said anchoring means further includes a pair of members attached respectively on said end platforms and capable of receiving said track at said opposite ends thereof so as to mount said arched track in a substantially stationary upright position extending in the arched configuration over the stage area.

3. The portable assembly of claim 1 wherein said track includes an elongated rod formed in the arched configuration, said rod having attaching elements defined on opposite ends thereof for fitting with said anchoring means.

4. The portable assembly of claim 3 wherein said rod includes a plurality of rod sections being coupled together in end-to-end relation.

5. The portable assembly of claim 1 further comprising:
   means connectable to the elements of scenes and movably mountable to said arched track for interconnecting the elements of scenes successively in a row and supporting the scenes from said track for movement along said track to and from centerstage and offstage areas.

6. The portable assembly of claim 5 wherein said interconnecting means includes at least one elongated sleeve being insertable over and slidably movable along said track.

7. The portable assembly of claim 6 wherein said interconnecting means also includes means mounted on said sleeve for releasably fastening scene elements on said sleeve.

8. The portable assembly of claim 1 further comprising:
   means locatable adjacent to said anchoring means and the opposite ends of said arched track for hiding offstage said anchoring means and the ones of the elements of scenes supported by said arched track but not presently being displayed at the centerstage area.

9. The portable assembly of claim 8 wherein said hiding means includes panels supported upright adjacent to and forwardly of said opposite ends of said arched track.

10. A portable assembly for storing, setting up, and rapidly changing elements of different theatrical scenes, said portable assembly comprising:

(a) a pair of anchoring means locatable at respective opposite ends of a stage area;

(b) an elongated stationary track mountable solely at its opposite ends by the anchoring means so as to extend in an arched relation over the stage area; and (c) means locatable adjacent to the anchoring means and the opposite ends of the arched track for hiding offstage the anchoring means and the ones of the elements of scenes supported by the arched track but not presently being displayed at the centerstage area.

11. The portable assembly of claim 10 wherein said anchoring means includes a pair of end platforms locatable at opposite ends of the stage area.

12. The portable assembly of claim 11 wherein said anchoring means further includes a pair of members attached respectively on said end platforms and capable of receiving said track at said opposite ends thereof so as to mount said arched track in a substantially stationary upright position extending in the arched configuration over the stage area.

13. The portable assembly of claim 10 wherein said track includes an elongated rod formed in the arched configuration, said rod having attaching elements defined on opposite ends thereof for fitting with said anchoring means.

14. The portable assembly of claim 13 wherein said rod includes a plurality of rod sections being coupled together in end-to-end relation.

15. The portable assembly of claim 10 wherein said hiding means includes panels supported upright adjacent to and forwardly of said opposite ends of said arched track.

16. The portable assembly of claim 10 further comprising:

means connectable to the elements of scenes and movably mountable to said arched track for interconnecting the elements of scenes successively in a row and supporting the scenes from said track for movement along said track to and from centerstage and offstage areas.

17. The portable assembly of claim 16 wherein said interconnecting means includes at least one elongated sleeve being insertable over and slidably movable along said track.

18. The portable assembly of claim 17 wherein said interconnecting means also includes means mounted on said sleeve for releasably fastening scene elements on said sleeve.

19. A portable assembly for storing, setting up, and rapidly changing elements of different theatrical scenes, said portable assembly comprising:

(a) a pair of anchoring means locatable at respective opposite ends of a stage area;

(b) an elongated stationary track mounted solely at its opposite ends by the anchoring means so as to extend in an arched configuration over the stage area, said track including an elongated rod formed in the arched configuration, said rod having attaching elements defined on opposite ends thereof for connecting with said anchoring means;

(c) means locatable adjacent to the anchoring means and the opposite ends of the arched track for hiding offstage the anchoring means and the ones of the elements of scenes supported by the arched track but not presently being displayed at the centerstage area; and (d) means connectable to the elements of scenes and movably mountable to said arched track for interconnecting the elements of scenes successively in a row and supporting the scenes from said track for movement along said track to and from centerstage and offstage areas, said interconnecting means including at least one elongated sleeve being insertable over and slidably movable along said track.

20. A portable assembly for storing, setting up, and rapidly changing elements of different theatrical scenes, said portable assembly comprising:

(a) a pair of anchoring means locatable at respective opposite ends of a stage area;

(b) an elongated stationary track mountable solely at its opposite ends by said anchoring means so as to extend in an arched configuration over the stage area; and (c) means connectable to scene elements and movably mountable to said arched track for interconnecting the scene elements successively in a row and for supporting the scenes from said track for movement along said track to and from centerstage and offstage areas;

(d) said interconnecting means including at least one elongated hollow sleeve being insertable over and slidably movable along said track and means mounted on an exterior surface of said sleeve for releasably fastening scene elements on said sleeve.

* * * * *